US007824068B2

(12) United States Patent
Wulfinghoff

(10) Patent No.: US 7,824,068 B2
(45) Date of Patent: Nov. 2, 2010

(54) LIGHTING FIXTURES AND SYSTEMS WITH HIGH ENERGY EFFICIENCY AND VISUAL QUALITY

(76) Inventor: Donald R. Wulfinghoff, 3936 Lantern Dr., Wheaton, MD (US) 20902

( * ) Notice: Subject to any disclaimer, the term of this patent is extended or adjusted under 35 U.S.C. 154(b) by 0 days.

(21) Appl. No.: 12/624,984

(22) Filed: Nov. 24, 2009

(65) Prior Publication Data

US 2010/0135017 A1 Jun. 3, 2010

Related U.S. Application Data

(60) Provisional application No. 61/200,444, filed on Nov. 28, 2008.

(51) Int. Cl.
*F21V 7/06* (2006.01)
*F21V 21/14* (2006.01)

(52) U.S. Cl. ..... 362/247; 362/248; 362/239; 362/249.03; 362/249.04

(58) Field of Classification Search ..... 362/237–239, 362/246–248, 249.02–249.04
See application file for complete search history.

(56) References Cited

U.S. PATENT DOCUMENTS

| | | | | |
|---|---|---|---|---|
| 6,350,041 | B1 * | 2/2002 | Tarsa et al. | 362/231 |
| 7,547,126 | B2 * | 6/2009 | Hiratsuka | 362/413 |
| 2002/0191397 | A1 * | 12/2002 | Loga et al. | 362/247 |
| 2002/0191398 | A1 * | 12/2002 | Keller | 362/247 |
| 2003/0103348 | A1 * | 6/2003 | Hung | 362/247 |
| 2004/0037088 | A1 * | 2/2004 | English et al. | 362/545 |
| 2009/0303718 | A1 * | 12/2009 | Zheng et al. | 362/249.02 |

OTHER PUBLICATIONS

US Dept. of Energy, LED Application Series: Portable Desk/Task Lighting, Feb. 2008.*
ASHRAE, ANSI/ASHRAE/IESNA Standard 90.1-2004, Energy Standard for Buildings Except Low-Rise Residential Buildings, 2004, section 9.4.1.4(d).*
IESNA, IESNA Lighting Handbook,2000, 9th ed., figs 7-39, 10-4, 11-6, 11-7, 11-14.*
Wulfinghoff, WEEC Proceedings, Ideal Task Lighting Becomes Reality, Oct. 2008.*
Wulfinghoff, Lay Out Lighting Using the Task Lighting Principle, Energy Efficiency Manual, 1999, pp. 1119-1129.

* cited by examiner

*Primary Examiner*—David V Bruce
(74) *Attorney, Agent, or Firm*—Berenato & White, LLC

(57) ABSTRACT

Lighting fixtures, systems, and methods of using the lighting fixtures that can achieve radically increased energy efficiency and visual effectiveness, are disclosed. The invention also offers the potential for decorative effects, supplementary background lighting, and other lighting effects. Various embodiments use light sources capable of individual focus, replacement, and control of operation. Fixtures allow mounting of the light emitting components to achieve a large effective aperture/diameter of the fixture in relation to the distance from the illuminated area, producing improved illumination. The light emitting components may be installed on parts of the fixture that may be oriented individually, thereby allowing infinite and/or incremental adjustment of the overall light emission pattern to achieve desirable illumination effects. Desirable lighting effects are further achievable by selection of the lighting type (LED, incandescent, fluorescent, etc), combinations thereof, and by selection of the fixture aperture/diameter, axis, and intensity. Shielding of the light sources to avoid glare to bystanders may be included.

31 Claims, 8 Drawing Sheets

LIGHTING FIXTURES AND SYSTEMS WITH HIGH ENERGY EFFICIENCY AND VISUAL QUALITY

This application claims the benefit of prior filed U.S. Provisional Application Ser. No. 61/200,444, filed Nov. 28, 2008.

BACKGROUND OF THE INVENTION

This invention relates to lighting, and lighting fixtures, and specifically to improving the energy efficiency and the visual quality of lighting for localized activity areas.

DESCRIPTION OF THE PRIOR ART

Lighting is a major consumer of energy, and prior art lighting is, in general, very wasteful of energy. In addition, the prior art fails to optimize visual quality, i.e., all the issues that produce effective vision and visual comfort. Attempts in prior art to achieve higher energy efficiency have compromised visual quality.

In lighting that is used for individual localized activities—such as reading, writing, working at a desk, working at machine tools, working at hobbies, and so forth—the shortcomings of the prior art include one or more of the following:

- Light is distributed wastefully, with much of the light energy (e.g., up to 90%) being lost outside the activity area.
- Lighting fixtures fail to provide uniformity of illumination across the activity area, forcing an overall increase in lighting energy in order to provide adequate illumination for the darker areas.
- Lighting fixtures that have a small aperture (e.g., typical "reading lamps") create sharp shadows in the activity area, provide non-uniform illumination, and inflict glare and veiling reflections on the viewer.
- Lamp shades that are intended to ameliorate the intense glare of light sources absorb a large fraction of the light and disperse the light in a wasteful manner.

In the prior art, a category of lighting exists called "task lighting," which is intended to save energy by concentrating light on an individual activity. Typically, task lighting employs lighting fixtures that are located within the activity area itself or on the periphery of the activity area. Experience has demonstrated that the here-to-fore known art of task lighting has serious deficiencies in visual quality, including:

- veiling reflections
- glare
- very uneven distribution of light within the activity area
- strong shadows within the activity area, cast by objects within the activity area, by the hands of the viewer, and by the other parts of the viewer's body.

In lighting that is used for spaces that contain a plurality of activity areas—such as a large office space with multiple desks, filing cabinets, a copy machine, and so forth—the shortcomings of the prior art include one or more of the following:

- Much of the light energy is distributed wastefully, outside the activity areas.
- The light output of the individual lighting fixtures is not localized sufficiently so that individual activity areas are illuminated exclusively by their own lighting fixtures. As a result, different activity areas rely on lighting fixtures in common with other activity areas. This makes it impossible for individual lighting fixtures to be turned off when individual activity areas cease to need illumination.

SUMMARY OF THE INVENTION

The present invention makes it possible to provide lighting for individual activities that avoids all sources of visual discomfort and all detriments to visual perception, while simultaneously minimizing the amount of energy needed to illuminate an activity. The invention allows the energy consumption for illumination of localized activities to be reduced to approximately one tenth of the amount used by conventional lighting.

The present invention achieves these desirable characteristics by combining, in single fixtures, a combination of lamp units, each lamp unit consisting of one or more light emitters (LED, compact fluorescent, etc.). The desired illumination of the activity area is the collective result of the operation of the lamp units. Ideal illumination is achieved by selecting or adjusting the characteristics of the lamp units and the light emitters within them.

The invention is able to optimize the collective illumination effect by selecting or adjusting these features of the lamp units: the spatial arrangement of the lamp units on the fixture, the number of lamp units, the individual aperture of the lamp units, the interaction between the lamp unit and its light emitter or emitters, the individual focus of the lamp units, and the direction in which the lamp units are individually aimed. The features of the individual lamp units may be selected or adjusted in a continuous or incremental manner.

The benefit of this invention also derives from the ability of the light fixture to employ all types of light emitters and to exploit most effectively their desirable characteristics, such as energy efficiency.

Further benefit is provided by the method of arranging multiple fixtures with respect to the activity area and the viewer.

Various embodiments of the invention may provide some or all of the following benefits, each of which is achievable without compromising any of the other benefits:

- This invention makes it possible to contain the distribution of light within the activity area, with only minimal waste of light in directions where it is not useful, thereby greatly enhancing energy efficiency.
- This invention makes it possible to turn off the fixture or plurality of fixtures that illuminate a given activity area without affecting the illumination of other activity areas and sub-areas, thereby greatly enhancing overall energy efficiency in situations where a plurality of persons are engaged in separate illuminated activities.
- This invention makes it possible for a lighting fixture to provide a high degree of uniformity of illumination of an individual activity area, such as a reading chair.
- This invention makes it possible to locate a plurality of fixtures so as to provide a high degree of uniformity of illumination over a large individual activity area, such as a large desk with side branches.
- This invention makes it practical to use light sources, such as LED's, that are limited individually to low wattage and light output, for lighting of any desired intensity.
- This invention makes it possible to provide highly efficient lighting at low energy input by using light sources, such as LED's, that operate with high efficiency at low energy input.
- This invention makes it possible to mute shadowing of the activity by the viewer's hands to a level that is unobtrusive while still providing useful depth cues.
- This invention makes it possible to avoid shadowing of the activity by other parts of the viewer's body.

This invention makes it possible to vary the illumination intensity within separate parts of the activity area as desired. For example, if a computer is located at the center of a desk, the illumination can be concentrated on the sides of the desk, with reduced illumination of the computer monitor and keyboard.

This invention makes it possible to locate the fixture (or fixtures) in a location (or locations) to avoid all glare for the primary viewer, even if the viewer turns with respect to the activity.

This invention makes it possible to avoid creating glare for outside viewers.

This invention makes it possible to locate the fixture (or fixtures) in a location (or locations) to avoid all veiling reflections for the primary viewer, even if the viewer turns with respect to the activity.

GLOSSARY OF TERMS

The following Glossary of Terms used herein is provided to aid in the understanding of the issues, theory, and equipment of the subject area of this invention:

aim. To adjust the direction of the optical axis of a lighting fixture, lamp unit, or directional light source.

activity. Something that is being done or viewed by a viewer, which the viewer desires to illuminate. Examples are reading, writing, working on a computer, sewing, working with a machine tool, etc.

activity area. A delimited area that a viewer desires to illuminate.

aperture. The effective width (diameter) of a lighting fixture, lamp unit, or directional light source in a plane perpendicular to the optical axis of the fixture, lamp unit, or directional light source, as stated. The aperture may differ in different directions perpendicular to the optical axis. For example, the aperture of a fixture may be wider than it is tall.

beam width. The angular width of the beam of light emitted by a lamp unit, measured from the optical axis, such that the beam width encompasses most of the light emitted by the lamp unit.

energy efficiency. In the general context of lighting, the ability of lighting apparatus to provide vision with relatively little input of energy. The energy input usually can be defined with a single parameter, such as wattage. However, the ability of the emitted light to provide vision depends on a multiplicity of parameters, among which are: the gross amount of visible light produced by the light source; the wavelength distribution of the light source in relation to the color characteristics of the scene; the wavelength distribution of the light source in relation to the response of human vision to different wavelengths; the tendency of the lighting apparatus to mitigate or exacerbate interferences with vision, such as glare and veiling reflections; the layout of the illuminated scene; and other factors.

fixture. See "lighting fixture," below.

focus. To shape the light output from a light source into a beam having a desired beam width.

glare. An interference with vision that is caused by an area of excessive brightness within the visual field of a viewer, sufficient to cause discomfort and/or visual desensitization.

holder. See "lamp unit holder," below.

lamp unit. A sub-assembly of the lighting fixture that contains a light source and the components needed to focus the light from the light source, and perhaps additionally, to aim the light beam from the light source.

lamp unit holder, or holder. A sub-assembly of a lighting fixture that holds the lamp units.

lighting fixture, or fixture. An apparatus for providing illumination. As a minimum, a lighting fixture requires a light source. Commonly, it also includes means to modify the light output of the light source, such as a shade or reflector.

light source. A primary emitter of light. Examples are incandescent bulbs, LED's, and fluorescent tubes. Some light sources require accessories to operate, as for example, fluorescent tubes require ballasts. Often called a "lamp," although the latter term also commonly means a lighting fixture.

optical axis. A line of orientation located along the center of the light distribution pattern of a fixture, lamp unit, or directional light source. If the light distribution pattern is not symmetrical, the optical axis lies along the center of the averaged intensity of the light distribution.

outside viewers. Persons who are not using the illumination of the fixture, but who are located where they can see the fixture and/or the activity area.

primary viewer. A person who is using the illumination of the fixture or fixtures for an activity.

scene. That which is viewed by a viewer. The scene may include an activity or any other part of the viewer's visual environment.

veiling reflection. An interference with vision, specifically with the perception of details on a smooth surface, such as paper, glass, polished wood, etc. The interference is caused by indiscriminate reflection of light that occurs from any smooth surface. The indiscriminate reflection masks the selective reflection of light that makes it possible to see details in the surface, such as printing. Veiling reflections occur when the angle of incidence of any light source with respect to the surface equals the angle of reflection from that surface into the eyes of the viewer.

viewer. A person who desires to view a particular scene or activity.

visual desensitization. A reduction of the ability of the eye to see dimly illuminated objects that is caused by exposure of the eye to excessive brightness. The excessive brightness may occur simultaneously in another part of the scene, or the eye may have been exposed to excessive brightness some time earlier.

visual quality. Collectively, those characteristics of lighting that improve effectiveness of vision and that make lighting comfortable for the viewer. Visual quality includes the ability of a viewer to perceive the details of the scene easily, avoidance of glare, minimization of veiling reflections, reasonably uniform illumination across the activity area being viewed, and other subjective factors. Visual quality is separate from energy efficiency, although improving visual quality may improve the potential for energy efficiency.

Background: Theory of Task Lighting

By way of providing context to the present invention, we define "ideal task lighting" as illumination of a specific activity area in a way that optimizes all requirements for visual effectiveness and comfort—without compromise—and that minimizes energy consumption.

This definition contrasts with task lighting as it has generally been promoted to date, which stresses energy efficiency but inadequately addresses the other factors needed to achieve satisfactory illumination.

In order to achieve ideal task lighting, a fixed geometric relationship is required between (1) the viewer, (2) the activity, and (3) the light sources. The ideal task lighting introduced by this invention maintains excellent illumination as the viewer turns and moves laterally to function visually within the confines of the activity area.

Ideal task lighting generally is limited to single activity areas, which generally are viewed by single individuals, although exceptions are possible. In a space that is occupied by multiple individuals engaged in disparate activities, each individual requires an independent complement of task lighting equipment. Further, no individual is dependent on light from the equipment complement of any other individual or activity area.

Ideal task lighting applies to many commercial activities, such as office work, work at machine tools, stations on a production line, bank teller stations, retailing that uses localized vending areas, and some food preparation activities. Task lighting also is applicable to various residential applications, including reading, hobbies, sewing, and workshop activities.

A single person may have more than one activity area, and each activity area requires its own complement of task lighting. And, one activity area may be shared by different persons. For example, a person may have a desk in a large space that contains desks for many other individuals, all of whom share a number of file cabinets. Each desk should have its own task lighting, and each group of file cabinets should have its own task lighting.

Activity areas that are used briefly have less stringent lighting comfort and energy efficiency requirements than activity areas that are occupied for long durations. For example, the task lighting for file cabinets should be designed for effective viewing of the open drawers, but it can use less efficient lamps than the task lighting for desks. Incandescent lamps might be used for the file cabinets because they are better adapted to lighting of short duration than are fluorescent lamps. Nonetheless, reliable controls are required to limit the duration of all lighting to actual need.

The spillover, or peripheral, illumination from efficient task lighting typically is adequate for safe access to the activity area, within a relatively short radius. However, the spillover is too dim for reading or work of similar visual requirements. Any activity that requires normal illumination requires its own complement of lighting equipment.

Task lighting is a sub-category of lighting technology in general, appropriate for applications of the kind that we described. Lighting technology should meet three general goals:

- energy efficiency
- visual quality that is comfortable and appropriate for the application
- optimized equipment features, including ease of installation and adjustment, ergonomic controls, and economy.

In the prior history of task lighting, energy efficiency has dominated the thinking of lighting specialists, with inadequate regard for the other two goals. Task lighting was introduced at a time when conventional lighting had already evolved to produce good visual effectiveness and comfort. The original task lighting was markedly inferior in these fundamentals, so task lighting has earned little enduring application, except with captive audiences, such as dental patients and airline passengers.

With respect to energy efficiency, this conceptual "formula" shows the factors that determine overall lighting energy efficiency:

LIGHTING EFFICIENCY=

Light Source Efficiency

×Fixture Efficiency

×Light Distribution Efficiency

×Control Efficiency

If we multiply together the factors by which each of these elements differ from perfect efficiency, we see why contemporary lighting is so deficient in energy efficiency. Ideal task lighting, as embodied in this invention, offers significant improvements in all four of the factors in this formula.

The first factor, light source efficiency, is improved because the task lighting equipment and methods of this invention allows the most efficient available types of light sources to be employed for task lighting. In particular, it allows optimum usage of LED lamps and other light emitters having high energy efficiency, even though they may be limited individually in light output.

The second factor, fixture efficiency, is improved over conventional lighting because task lighting as embodied by this invention uses fixtures that employ reflectors or lenses to control the aiming of the light, and these typically limit light losses to 10% to 20% of the output of the light source.

The third factor, efficient light distribution to the activity, limits most of the light to the activity area, where it is needed. This factor was the original appeal of task lighting, and is where task lighting originally failed by creating uncomfortable and ineffective lighting as a price of limiting the light distribution. Ideal task lighting, as embodied in this invention, improves the localization of the illumination, while eliminating factors that make vision inefficient or uncomfortable. Further, by eliminating veiling reflections and glare, ideal task lighting further improves efficiency by reducing the amount of light energy that is needed for vision.

The fourth factor, control efficiency, is greatly enhanced because efficient light distribution makes it possible to entirely limit lighting to the needs of a single individual or activity area. Thereby, ideal task lighting allows lighting energy to be reduced in direct proportion to the occupancy of the space. In contrast, contemporary lighting of large spaces is largely independent of the number of people within the space.

Further, ideal task lighting allows the lighting energy consumption of a single individual to be divided between long duration activity, such as work at a desk, and short duration activity, such as fetching folders from a file cabinet.

As to visual quality, the purpose of lighting is to enhance vision. We use the term "visual quality" for the ability of lighting to satisfy this goal. If there is a conflict between visual quality and energy efficiency, users will sacrifice efficiency to improve visual quality. Ideal task lighting, as embodied in this invention, eliminates such conflicts.

DETAILED DESCRIPTION OF THE PREFERRED EMBODIMENTS

Figure 1A:
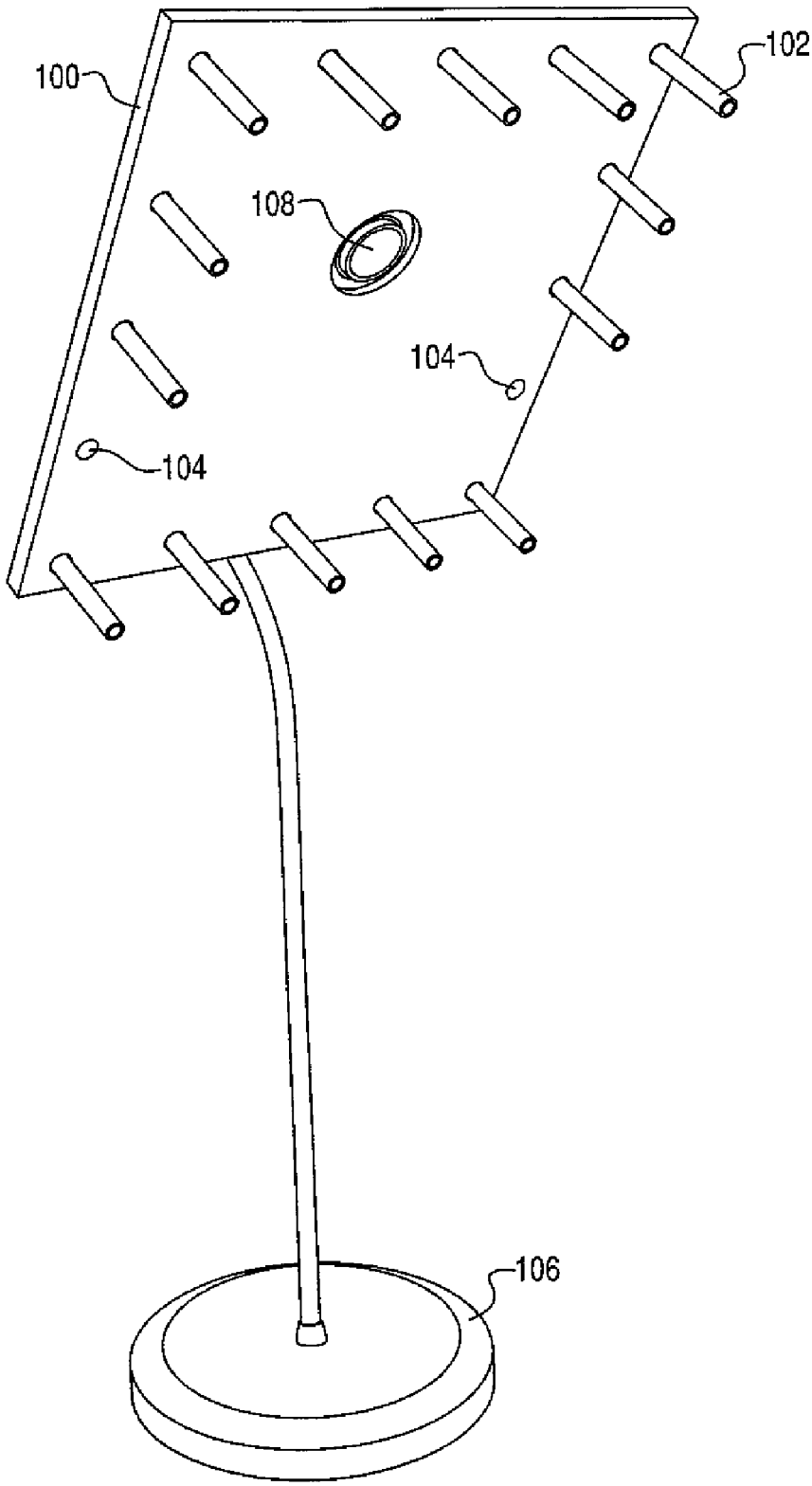
FIG. 1A is a light fixture incorporating the present invention, with a rectangular multi-lamp unit holder.
Figure 1B:
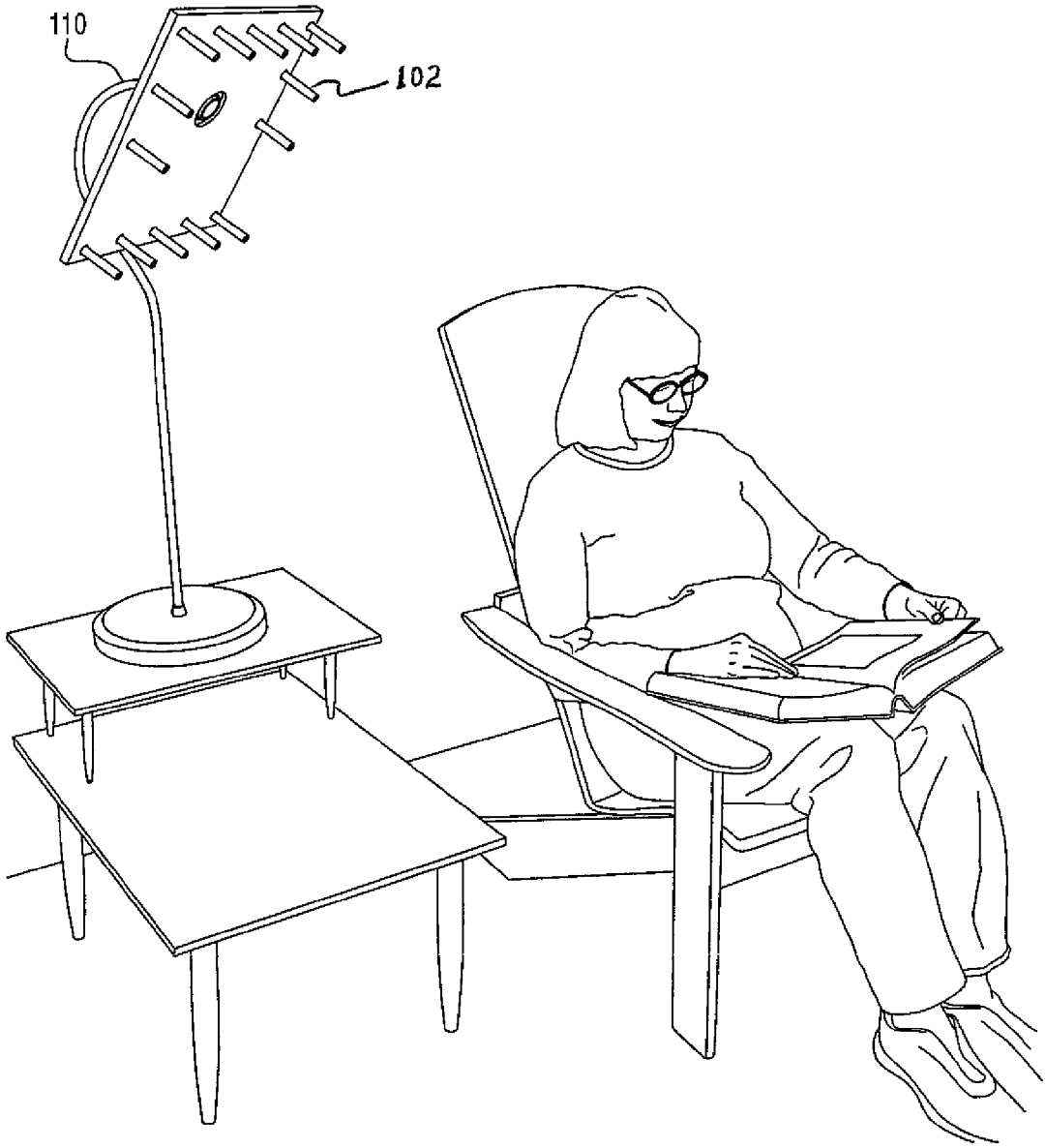
FIG. 1B shows the fixture of embodiment in FIG. 1A in use.

FIGS. 1A and 1B show a lighting fixture embodiment of the present invention. The fixture includes a multi-lamp unit holder 100. The holder 100 is shown as a rectangular sheet of thin plywood (0.25 inch or so), but could use other suitable lightweight rigid sheet materials (e.g. metal sheeting, fiberglass, fiberboard, etc). In this version, lamp units 102 are flashlights that are capable of being focused individually, by turning the heads of the flashlights. Each lamp unit can be turned on and off individually so as to effect the discreet lighting patterns a user may seek. Mounting holes 104 are drilled around the perimeter of the lamp unit holder 100 in any desired pattern or configuration. The mounting holes 104 are roughly the same diameter of the lamp units 102, allowing the lamp units to be held in place by friction. In this way, the lamp units 102 can be inserted, removed, and relocated easily as desired.

A tabletop stand 106, which allows the illumination to come from a location above the head of the viewer and, ideally, alongside or slightly behind the head of the viewer as shown in FIG. 1B is suitable for a lamp base. Further, an easily removable connection, 108 (FIG. 1A), between the lamp unit holder and the stand, which allows rotational adjustment of the holder in a plane perpendicular to the optical axis of the fixture. The connection 108 may include a plastic nut that is threaded on to the outside of an unused socket of the lamp stand, sandwiching the lamp unit holder 100 in place. A movable joint or corrugated sheath 110 (FIG. 1B) that allows adjustment of the tilt of the holder 100 and that allows rotation around the axis of the joint is also preferred.

The method or arrangement of wiring and connecting the electrical components and of making the mechanical connections will be well known to those with ordinary skill in the electrical and mechanical arts. All lights of a certain pattern may be controlled from a single switch, a further combination controlled from a second switch and, finally, a switch for all power to a given fixture. Various permutations of selective lighting control can be derived. Likewise, although the preferred mounting is on a portable base 106, the fixture could be mounted from a base or track on the ceiling, wall, floor, the furniture, or other location for both suspension and electrification. Likewise, remote control units similar to those used for ceiling fans may be employed.

Figure 2A:
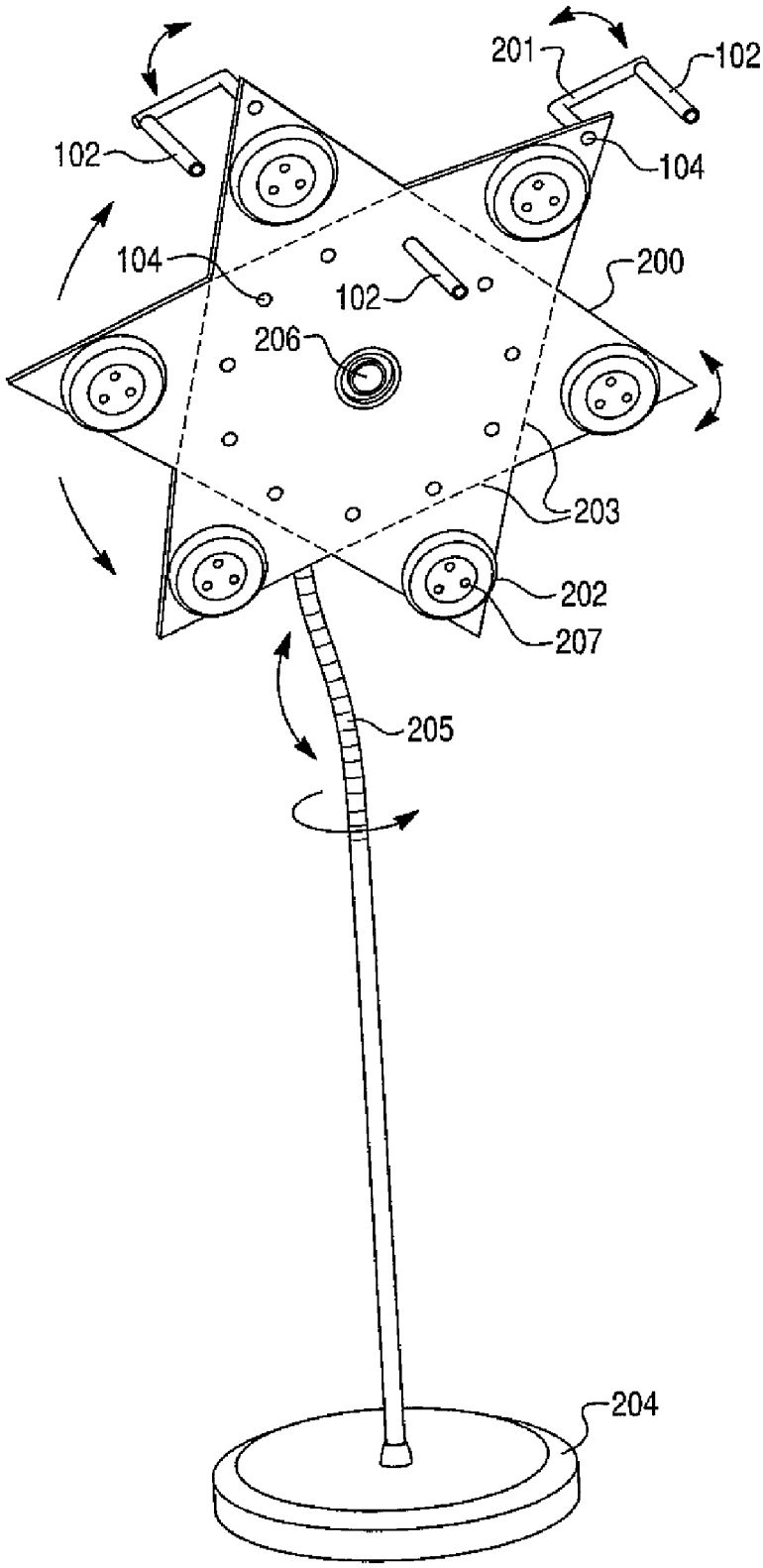
FIG. 2A is a variation of the invention lighting fixture with a star shaped multi-lamp unit holder including several aspects of the present lighting system.
Figure 2B:
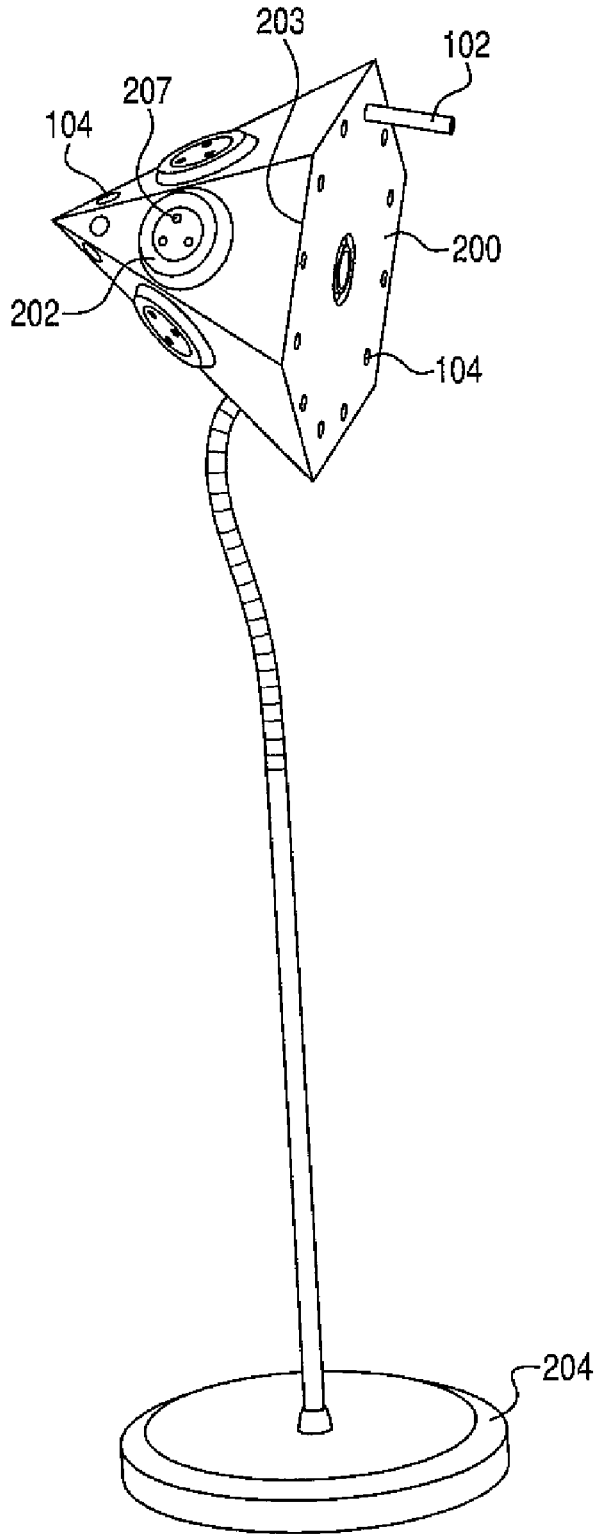
FIG. 2B shows the fixture of FIG. 2A with the foldable reflector's expanding elements completely folded to provide ambient illumination and a smaller overall fixture.

FIGS. 2A and 2B show an alternative embodiment of a lighting fixture using the present invention and represents a synthesis of many of the features and lighting concepts disclosed throughout this specification. This version includes a lamp unit holder 200 that is a star-shaped sheet of fiberboard. Other light weight and suitably rigid holders may also be used (e.g. sheet metal, sheet plastic, molded shapes, etc.). The multi element lamp units 202 are shown mounted generally on the points of the star shape (any suitable geometric configuration can be used according to style or taste or need). Each lamp unit 202 should be a commercially available product and may ideally be a cluster of several LED lamps 207 mounted in a common housing and operated by batteries. The lamp units are attached to the holder 200 with adhesive (or other suitable mount, e.g., screws, foam tape, etc.). Ideally, the lamp units 202, including individual LEDs, can be turned on and off individually so as to perfect a lighting effect sought by the user.

In addition to the LED clusters 207, the light mount 200 may include receivers/mounting holes 104 for focusing light units 102, in a fashion similar to that shown in FIG. 1A. The unit holder may also include a bendable aspect using hinges or material flexibility (light weight sheet metal, plastic with molded hinges, etc.) along axes 203. Where the holder 200 is made of a moderately bendable material (e.g., aluminum sheeting), the aiming of the lamp units 202 can be adjusted toward or away from the optical axis of the fixture by bending the points of the star shaped lamp unit holder 200. If equipped with hinges along axes 203, the LED clusters 202 may be folded completely back (FIG. 2B) to reveal a light fixture comprising only the focusing light units 102 arranged as desired on mount 200. In this configuration, the LED clusters can provide ambient illumination if left switched on, or can be switched off altogether. The light fixture in this folded configuration assumes a smaller size and can be used in more locations (e.g. bedside, small workspace light, etc.).

For a differing task or lighting need, the mount 200 portions (the points of the star shape, or other regular shape) can be bent (in the configuration shown in FIG. 2) so as to bring the LED clusters 202 into use with the focus light units 102, or likewise, the focusing lights 102 can be switched off altogether with only LED lights in use. In addition, the mount 200 may further include moveable stalks 201 also equipped with either LED clusters or focusing light units. The stalks may be swiveled and folded away against the edge of the mount 200, or extended so as to increase the overall diameter of the fixture vis-à-vis the object or area being illuminated.

The FIG. 2 fixture is also advantageously equipped with a goose neck type support 205 that enables any combination of rotation and bending. This type of mount enables infinite adjustment of the angle and aim of the lights mounted thereon.

A tabletop stand 204, which allows the illumination to come from a location above the head of the viewer and alongside or slightly behind the head of the viewer, is shown. Likewise the easily movable connection 206, between the lamp unit holder 200 and the gooseneck 205, which allows rotational adjustment of the holder 200 in a plane perpendicular to the optical axis of the fixture, is preferred. The connection 206 may include a plastic nut that is threaded on to the outside of an unused socket of the lamp stand, sandwiching the lamp unit holder 200 in place.

As in the first embodiment, the method or arrangement of wiring and connecting the electrical components and of making the mechanical connections will be well known to those with ordinary skill in the electrical and mechanical arts. Again, a base or track on the ceiling, wall, floor, the furniture, or other location can be used to support and energize the fixture.

FIGS. 3A, 3B, 3C and 3D show a lighting fixture that is another embodiment of the present invention. This fixture in one embodiment includes a single focusing reflector 300 having a large aperture and a relatively short axial dimension. A longer axial dimension version 400 is also a possibility. This embodiment is preferably equipped with a linear lamp unit (florescent, linear LED stalk with multiple outwardly reflector directed LED units, as in FIG. 3C, etc.) with an integral ballast unit 302 (as necessary, FIG. 3B), mounted along and in alignment with the optical axis of the reflector in a position where most of the light emitted from the lamp is directed toward the reflector. This embodiment includes a tabletop stand 304, which includes an electrical socket for the lamp and an easily removable attachment for the reflector. The stand 304 makes it possible for the illumination to come from a location above the head of the viewer and alongside or slightly behind the head of the viewer. An adjustable joint 306 and/or gooseneck (FIG. 3A), is also shown as a part of the lamp stand, which allows adjustment of the tilt of the holder and which allows rotation around the joint. Finally, an on/off switch 308 (FIG. 3A) is shown, which controls electrical power from an external electricity supply.

A variation on this embodiment is a version including an enlarged reflector 400 (shown in dotted outline). The enlarged reflector 400 is similar to the version in FIG. 3A, except the reflector would extend considerably further along the optical axis. These versions are shown in use in FIG. 3D. The object of the axially elongated reflector is to better contain ambient glare from individuals laterally positioned from the lighting fixture and also to make better use of the available light as to the surfaces to be lit.

Figure 3A:
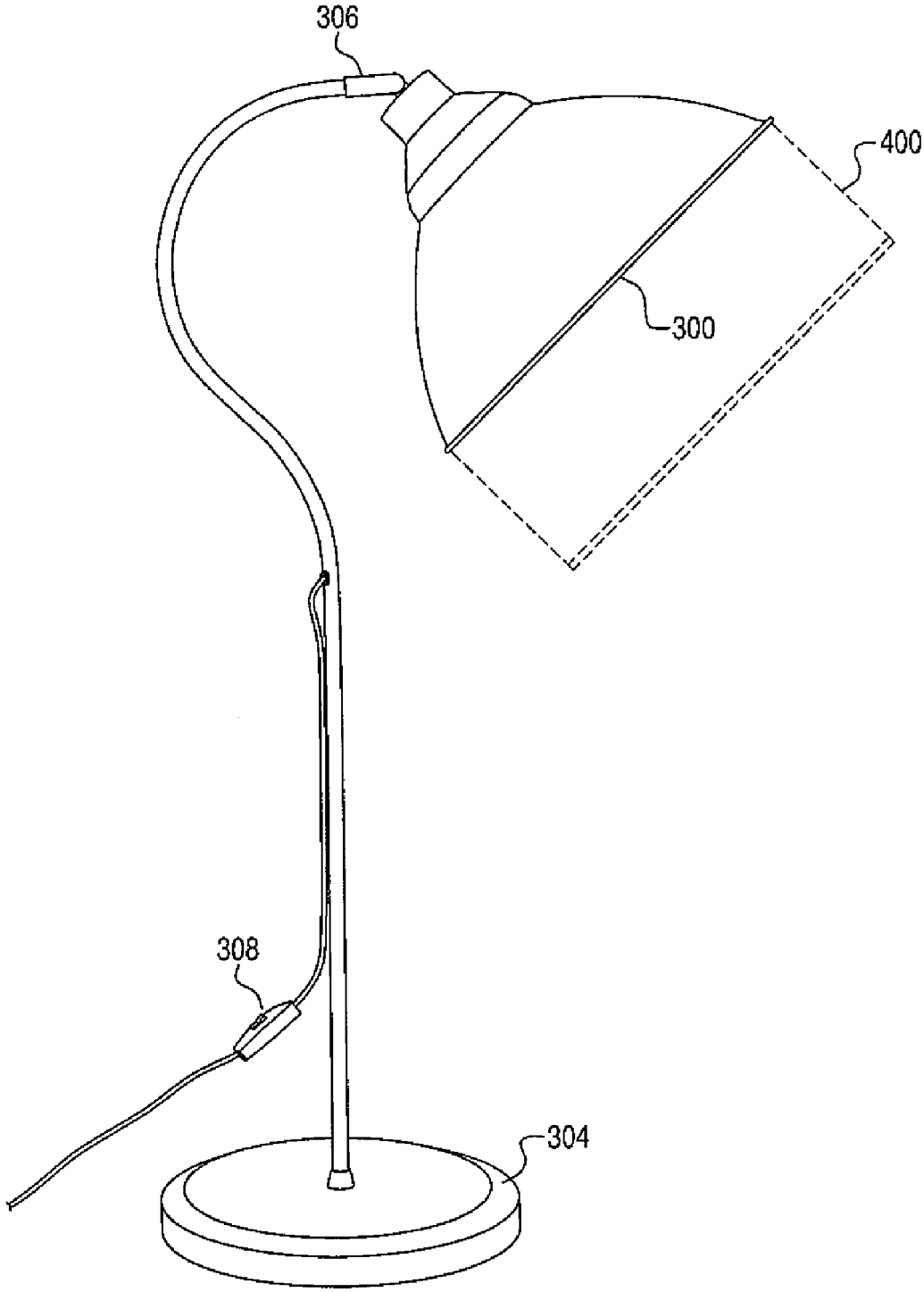
FIG. 3A is a lighting fixture in accord with the present invention using a single large reflector in either a larger or smaller axial dimension.
Figure 3B:
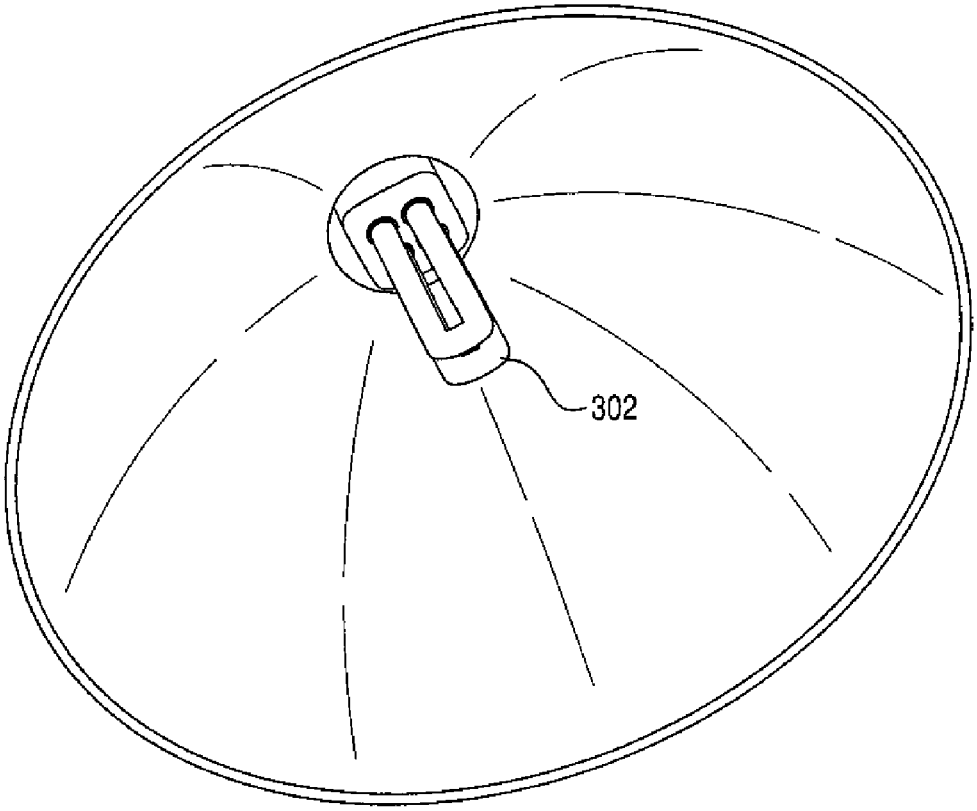
FIG. 3B shows the reflecting surface of the reflector of the fixture in FIG. 3A, using a long axis single lamp unit.
Figure 3C:
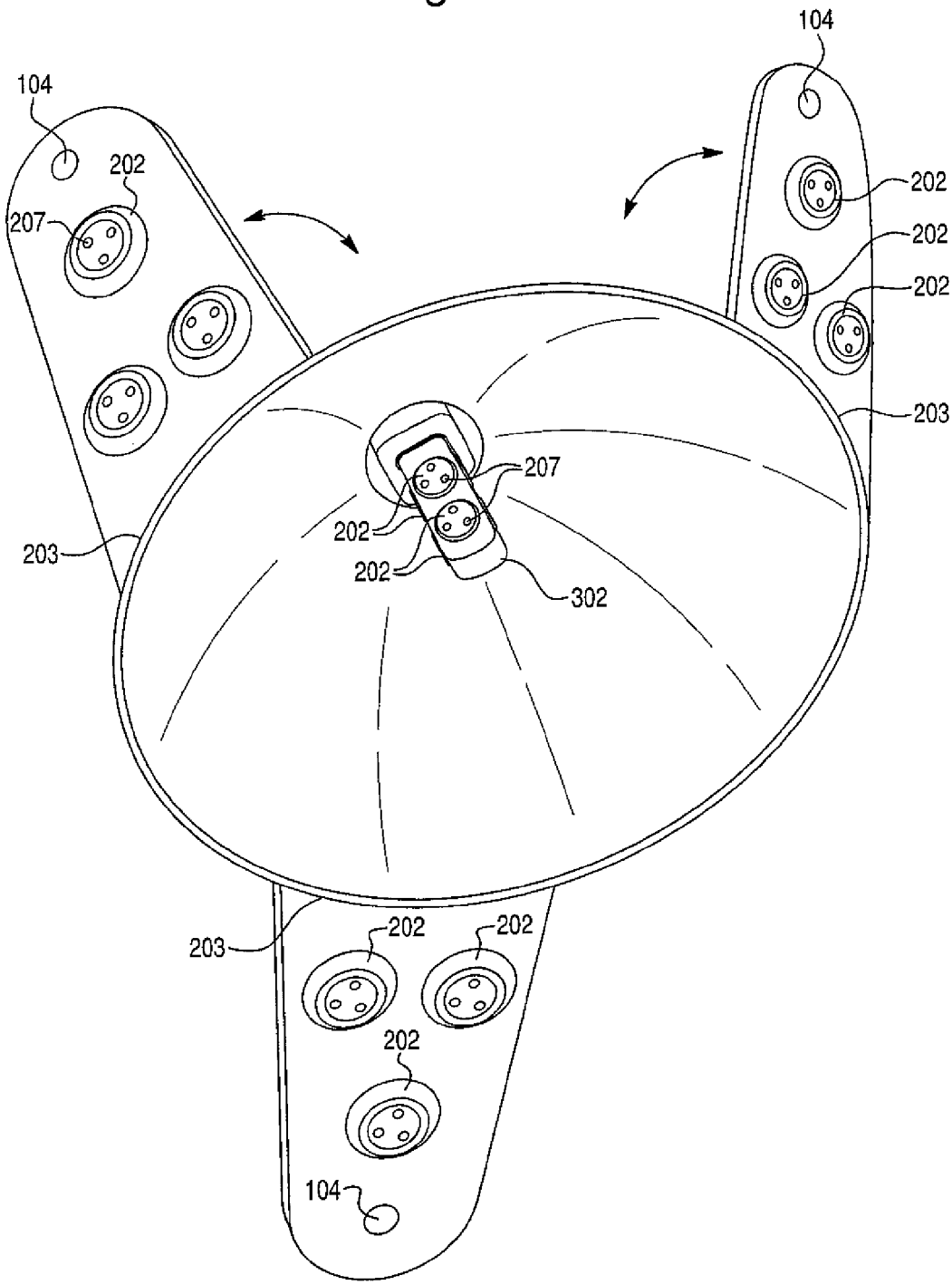
FIG. 3C shows a fixture of the type shown in FIG. 3B with an axially oriented LED stalk light emitter and foldable reflector extension elements.

A further variation, as shown in FIG. 3C, may include light unit supporting flaps extending from and around a periphery of the reflector 300, 400 rim. In the same way as in the FIG. 2 embodiment, these flaps, equipped with LED clusters 202 and/or stalks with focus lights, may be folded backward for ambient illumination, or folded outward to enlarge the diameter of the fixture, or folded inward to provide more light along the optical axis of the fixture. As in FIG. 2, a single multi-configurable fixture can bring together each and every aspect of efficient task lighting illumination.

As in the prior embodiments, the method or arrangement of wiring and connecting the electrical components and of making the mechanical connections will be well known to those with ordinary skill in the electrical and mechanical arts.

Operation of the Invention

In operation, the FIGS. 1 and 2 embodiments and in other embodiments that use a plurality of lamp units, the light beams overlap or join to produce an advantageous pattern of illumination and advantageous illumination characteristics on the activity area being illuminated. The use of a large aperture for the fixture provides the ability of the illumination to come from a plurality of directions, and the use of a large lamp unit holder provides space for mounting a plurality of lamp units, allowing individual lamp units to be aimed and focused to contribute to a pattern of optimum illumination.

In the embodiment of FIG. 3, the large aperture of the reflector, combined with a lamp unit that emits light in a pattern that exploits the aperture and axis of the reflector, acts as if an infinite number of minuscule lamp units were located on the reflector. The light emission pattern of the lamp unit, its position relative to the reflector, and the shape of the reflector collectively determine the pattern of light distribution from the reflector. If equipped with movable appendages for mounting lamp units, further lighting configurations can easily be derived and implemented.

Another aspect of this invention is that the aimed fixtures have a radiating surface that is large in width. This feature is a major contributor to uniformity of illumination, it is needed to mute self-shadowing, and it provides pleasing but reasonably contained spillover to the perimeter of the activity area. Experimentation has shown that the radiating width should be about 25% to about 35%, e.g. a significant fraction, of the distance from the fixture to the task area, for most activities. In the embodiment of FIG. 3, using optics jargon, this geometry puts the activity area close to the "near field" of the fixtures, which provides uniform illumination even though the fixture is sharply focusing at long distances.

With focusing reflectors, the width of the radiating surface is equal to the diameter, or approximately so. The relationship is approximate if the reflector has a non-circular beam, or if the reflector is cut in a slanted section, for example, to provide glare shielding. An upper limit on fixture width is intrusion of the fixture into the viewer's field of vision, causing light source glare. Our recommended width ratio avoids this problem. The fixtures may be made deliberately narrower for activities in which surface shadowing is desirable for contrast, as with engraving and other activities involving surface texture.

The present invention achieves optimum lighting by using some or all of the following characteristics of the lighting fixture or fixtures. To with: the aperture of the fixture or fixtures; the number of lamp units installed in each fixture; the location of the lamp units on the holder; the aperture of the lamp units; the individual aiming of the lamp units; the focusing of the lamp units; the light output of the light sources; the energy efficiency of the light sources; the location of the fixture or fixtures with respect to the activity area; and, the location of the fixture or fixtures with respect to the primary viewer.

A major advantage of the invention, both for energy efficiency and visual quality, is its ability to tailor the illumination closely to the illumination requirements of the activity area, while limiting the expenditure of light energy to that area. Narrowing the focus of each lamp unit allows more accurate delimiting of the overall illuminated area. Increasing the number of lamp units provides illumination of a larger activity area while maintaining accurate delimiting of the illumination to the activity area. In addition, the intensity of illumination can be adjusted efficiently to satisfy the requirements of the activity and the user. The intensity of illumination is determined primarily by the light output of the light sources and by the number of light sources. Further, the intensity of illumination can be varied among different parts of the overall illuminated area. For example, narrowing the focus of each lamp unit allows more localized adjustment of intensity. Another example is that increasing the number of lamp units increases ability to tailor the illumination pattern to the activity.

Energy efficiency is further maximized by using the most efficient available light sources, by using means of focusing the light that absorb or disperse a minimum of the light, and by arranging the light distribution to avoid impairment of vision by glare, veiling reflections, shadowing of the activity, and excessive variation in illumination level.

The darkness and sharpness of shadows within the activity area can be reduced by increasing the aperture of the lighting fixture, by increasing the number of lamp units, and by distributing the lamp units fairly uniformly around the fixture.

Figure 3D:
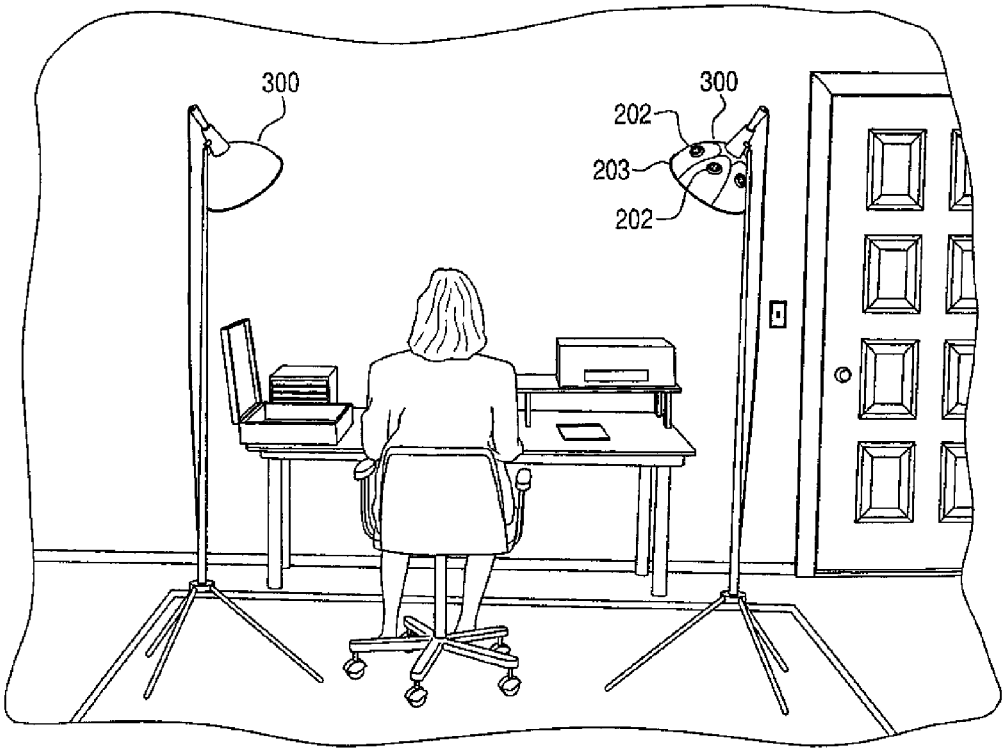
FIG. 3D shows a pair of fixtures of the type shown in FIGS. 3A and 3C, in use to illuminate a desk.

In addition, the uniformity of illumination across the activity area is enhanced by mounting the fixture approximately perpendicular to the activity surface. If the activity is primarily horizontal, the fixture is mounted relatively high above the activity, as in FIGS. 1B and 3D. The size of the activity area over which relatively uniform illumination is provided can be increased by mounting multiple fixtures on opposite sides of the activity area, lateral to the viewer. The benefit of this technique is especially great for wide activity areas, such as a desk. FIG. 3D illustrates this fixture positioning. Glare is best eliminated for the primary viewer by mounting the fixture or fixtures above the head of the viewer and somewhat to the rear of the viewer's primary orientation. FIGS. 1B and 3D illustrate this principle.

Veiling reflections are eliminated by mounting the fixture to the side of the activity area, as in FIGS. 1B and 3D. If pairs of fixtures are employed, uniformity of illumination over a large activity area can be achieved while avoiding veiling reflections by installing the fixtures laterally on either side of the viewer.

Further Embodiments

Further embodiments of the invention herein are possible, and may include the following, (grouped as they relate to various components, arrangements, and applications).

As to the lamp unit holder: The holder may be made of many structural materials, among which are plastic, metal, or wood, or combinations of materials. The holder may take many shapes, among which are a circle, ellipse, rectangle, or star shape, provided that the shape provides for mounting the lamp units in a manner that creates a sufficiently wide aperture. The surface of the holder on which the lamp holders are mounted may be planar or it may be curved on one or more axes for a variety of purposes, such as achieving a desired appearance, facilitating assembly, or aiming the lamp units. Embodiments that allow a lamp unit holder of one configuration to be removed and replaced easily with a lamp unit holder of a different configuration. Embodiments in which the mounting of the lamp unit holder on the fixture may provide for rotation with respect to the optical axis, to allow the light distribution from a non-circular arrangement of lamp unit holders to be matched to the shape of the activity area.

As to the mounting of the fixtures: The fixture(s) may be held by an attachment to the ceiling, or to a wall, or to a floor stand, or to a tabletop stand, or to furniture. Embodiments may include a mounting of the fixture that allows adjustment of the direction of the optical axis by the user. Included among the means that may be used for this purpose are a ball-and-socket joint, a flexible gooseneck, hinges, and joints rotating about pins or bolts. Embodiments may include a mounting for the holder that allows rotation with respect to the optical axis, which would allow the light distribution from a non-circular arrangement of lamp units to be matched to the shape of the activity area.

As to methods of focusing and concentrating the emitted light: The lamp unit(s) may use a focusing reflector to focus the light from the light source. The lamp unit(s) may use a lens to focus the light from the light source. The lamp unit(s) may use a combination of a reflector and a lens to focus the light from the light source.

As to the number of lamp units: The fixture(s) may contain any number of lamp units, provided that a sufficient number is installed to provide an aperture that is large enough to provide the benefits, stated previously, that result from the extended aperture of the fixture. Another embodiment comprises a single focusing reflector having an aperture that is large enough to provide the benefits, stated previously, that result from the extended aperture of the fixture. Such a large reflector has, in effect, an infinite number of effective lamp units on its surface, which are aimed by the curvature of the reflector.

The reflector in this embodiment may be similar to equipment used by photographers. However, the light sources may consume a small fraction of the high wattage of the lamps used for photographic applications. The function of this embodiment is to provide comfortable and efficient vision for a viewer over an extended period of time, along with high energy efficiency. In contrast, the application of reflectors in photography is to illuminate persons and scenes as subject matter to be photographed, with no relevance to quality of vision for persons within the scene and with minimal relevance to energy efficiency.

In the embodiment of a single focusing reflector of large aperture, the light source is preferably elongated along the optical axis, so as to emit its light to the outer portion of the reflector, thereby maximizing the benefit of the large aperture of the fixture. See FIG. 3B. Likewise, the shape of the reflector may be adjusted to provide different light distribution patterns. Included among possible variations are variations in the curvature of the reflector in cross sections that pass through the optical axis, variations in the shape of the reflector in cross sections perpendicular to the optical axis, and variations of the length of the reflector along the optical axis.

As to the arrangement of the lamp units on the holder: Embodiments may include versions in which the manufacturer or the user can change the positions of the individual lamp units on the lamp unit holder. For example, see FIG. 1A, where the lamp units may be installed in any of the mounting holes on the holder.

As to the types of light sources: Embodiments may employ various types of light sources, among which are light emitting diodes (LED's) and related semiconductor devices, incandescent lamps, compact fluorescent lamps, and other light sources that are capable of being focused. Embodiments may include those wherein the fixture contains a plurality of light source types. For example, LED's of different types may be used to improve color rendering. Or, the fixture may contain different types of light sources for different activities within the same activity area. Embodiments of fixtures may have a plurality of light source types, in which the types of light sources can be selected individually by the user.

As to the types and numbers of lamp units: Embodiments may include fixtures that contain a plurality of lamp unit types. For example, some lamp units of small aperture may be installed to provide accurate delimiting of illumination at the edges of the activity area, while lamp units of larger aperture are used to illuminate the inner portions of the activity area. Embodiments containing a plurality of lamp unit types may allow the user to switch different types on/off individually. Embodiments may allow the user to install different types of lamp units and light sources on the holder, using convenient connectors.

As to the aperture of the lamp units: For lamp units that use a focusing reflector, the aperture of the lamp units may be increased by extending the reflector. In embodiments in which the lamp units employ a focusing reflector, another smaller reflector may be located ahead of the light source on the optical axis of the lamp unit, the latter shaped to direct light from the light source toward the outer part of the larger reflector, thereby increasing the effective aperture of the lamp unit. Embodiments of the fixtures may contain lamp units having a plurality of apertures. For example, in metal engraving, where the visual perception of the activity largely depends on shadows within the engraved surface, the fixture may contain lamp units of small aperture to maximize those shadows. The same fixture may include lamp units of larger aperture to provide illumination for access to tools and to avoid excessive shadowing of the work by the engraver's hands. Embodiments of fixtures may employ closely spaced clusters of light sources as lamp units, the light sources being focused by individual lenses or a collective lens, or by individual reflectors or a collective reflector, or both.

As to the beam width of the lamp unit(s): The beam width of the lamp units may be adjusted in a variety of ways. The lamp units may be manufactured in a plurality of beam widths, so that the beam width is selected as an optional feature of the fixture. If the beam from the lamp unit is focused with a reflector, the beam width of the lamp unit may be adjusted by changing the relative positioning of the light source and the reflector, for example, as is commonly done in some flashlights. If the beam from the lamp unit is focused with a lens, the beam width of the lamp unit may be adjusted by changing the relative positioning of the light source and the lens. The beam widths of the lamp units may be individually adjustable. The beam widths of the lamp units may be adjustable collectively by a linkage that connects the adjustment feature of the lamp units, and that is connected to a handle, knob, motor, or other means of convenient adjustment by the viewer. The beam widths of the lamp units may be adjustable collectively by mounting all the light sources on one sub-assembly and all the reflectors or lenses on another sub-assembly, and using a mechanism to adjust the relative positions of the two sub-assemblies. Further, in this last embodiment, the two sub-assemblies may be adjustable with respect to each other so that their relative positions differ from one side to the other, so that the beam widths of the lamps may be varied from one side to the other.

As to the aiming of the lamp units: For lamp units whose optical axis is not individually adjustable, aiming of the optical axis can be achieved in a variety of ways, either singly or in combination. One is by selecting the location of the lamp units on the lamp unit holder, with a plurality of mounting locations being provided on the holder in excess of the number of lamp units. One embodiment of this alternative is shown in FIG. 1A. Further, an embodiment can provide a curvature of the surface of the lamp unit holder that faces the activity, such that the curvature acts to aim the lamp unit attached to it. Also, different lamp units in a fixture can be aimed individually by making the shape of the lamp unit holder alterable, as for example, in FIG. 2.

Alternatively, the lamp units may be made so that they can be aimed individually after installation, using various methods, among which are the following: a ball-and-socket mounting for the lamp unit, wherein the socket is attached to the lamp unit holder and the ball is part of the lamp unit; a flexible gooseneck that is part of the mounting of the lamp unit on the holder; and, joints capable of rotating about pins or bolts.

Alternatively, the aiming of the lamp units may be done by adjustment of the lamp units collectively in groups using various methods, among which are the following: connecting the collectively controlled groups of lamp units by linkages, so that all the connected lamp units change the direction of their optical axes by the same amount, the linkage being connected to a handle, knob, motor, or other means of convenient adjustment by the viewer. Or, connecting the collectively controlled groups of lamp units by linkages, so that all the connected lamp units change the direction of their optical axes differentially, acting to concentrate or to disperse the light produced by the connected group, the linkage being connected to a handle, knob, motor, or other means of convenient adjustment by the viewer.

As to shielding viewers outside the activity area from the glare that results from the brightness of the light sources, there are methods that can be made part of the fixtures themselves and methods that are separate from the fixtures. In lamp units that use reflectors to focus the light, the reflectors are extended along the optical axis to narrow the angle from which the light sources are visible. Baffles may be installed on the lamp unit holder around the individual lamp units, or in a location between the lamp units and possible locations of outside viewers. A baffle may be installed on the lamp unit holder to surround the fixture as a whole, or in a location that will block light from the lamp units to possible locations of outside viewers. Baffles may be mounted separately from the fixtures, interposed between the location of the fixture and the possible locations of outside viewers. Such separate baffles may be mounted in various ways, among which are suspension of fabric or other sheet material from the ceiling, and the mounting of rigid sheet material on holders attached to stands or furniture.

If the light emitters have focusing reflectors, the reflectors can be adapted to serve as baffles to shield bystanders from glare. For example, the small focusing flashlight-type light emitters 102 could be equipped with relatively deeply skirted small diameter parabolic reflectors. The reflector becomes an effective glare shield when the ratio of reflector depth to opening width exceeds approximately 2 to 1. In that respect, the geometry is similar to that of the large reflector shown in FIG. 3A, with skirt 400. In this embodiment, a viewer's gaze to the light emitters is interrupted by the skirts of their reflectors, and the viewer observes only a muted glow of light at the mouths of the reflectors, as opposed to the glare from the sharp light of the light emitters themselves.

As to the power supply: A fixture may be energized from any suitable source of power, among which are public electricity, a battery, a fuel cell, or other power sources. The source of energy for the light sources may power each light source individually or power the light sources collectively or in groups. The fixture may include any accessory device needed to provide energy to the light sources, among which are a voltage converter, ballast, or other device required by the light source. If the fixture is energized by an external source of power, it may have a detachable connection. Control of the operation of the fixture may be accomplished by a multiplicity of devices that can operate the fixture in accordance with need by the viewer, among which devices are manual switches, sensors that detect the presence of a viewer, and time controls.

Variations on this invention can be derived by those of ordinary skill from the description provided herein, and would remain within the scope of the appended claims.

The invention claimed is:

1. A lighting fixture, with high energy efficiency and visual quality for illuminating localized activity areas, comprising:

a plurality of lamp units;

each of said lamp units containing one or more light sources that can be focused;

said lamp units being mounted on a holder;

said holder providing for the mounting of said lamp units in an extended pattern that has an effective diameter that is a greater than 20% of the distance from the fixture to the illuminated area, whereby illumination of the area comes from a plurality of directions;

the light beams from said light sources being aimed to combine on said area in an illumination pattern of desired characteristics.

2. The lighting fixture of claim 1, wherein:

the said light sources or the said lamp units are separately switchable in a desired combination.

3. The lighting fixture of claim 1, wherein:

the said light sources are light-emitting diodes (LED's) or other light sources of limited power input, installed in the fixture in numbers sufficient to achieve a desired level of illumination intensity.

4. The lighting fixture of claim 1, wherein:

said holder includes reconfigurable means to reorient one or more of said lamp units to adjust the light distribution pattern of said lighting fixture.

5. The lighting fixture of claim 1, wherein:

one or more of said lamp units are mounted on movable appendages of said holder, allowing for the orientation of the light emission from said one or more lamp units to be adjusted over a wide range.

6. The lighting fixture of claim 1, wherein:

at least one visual baffle is attached to said fixture to protect viewers outside the activity area from glare created by the light sources of said fixture.

7. The lighting fixture of claim 6, wherein:

at least one of the said baffles comprises a reflector that is used to shape the light emission from the light sources of said fixture.

8. A lighting fixture, with high energy efficiency and visual quality for illuminating localized activity areas, comprising:

a centrally positioned focusing reflector of large aperture, the shape of which is selected to achieve a desired light distribution pattern;

a first lamp unit installed in said reflector that is elongated along the optical axis of said reflector and positioned so that most of the light from said first lamp unit is directed at the inner surfaces of said reflector, and thence is distributed efficiently toward the desired area to be illuminated;

at least one additional second lamp unit associated with said fixture that is positioned laterally outwardly with respect to the optical axis of said focusing reflector, so that the overall illumination pattern of said fixture results from the illumination produced by said reflector and said first lamp unit in combination with the illumination produced by said at least one additional second lamp unit.

9. A lighting fixture as in claim 8, wherein:

said first lamp unit that is elongated along the optical axis of said reflector comprises a plurality of individually switchable LED light sources or other small light sources that can be aimed.

10. A fixture as in claim 8, wherein:

said first lamp unit that is elongated along the optical axis of said reflector comprises a florescent tube or other individual light source having a light distribution pattern that emits most of the light toward the surface of said reflector.

11. A fixture as in claim 8, wherein:

said at least one second lamp unit comprises a cluster of LED light sources or other small light sources that can be aimed, which are mounted on an extendable reconfigurable surface of said lighting fixture.

12. A fixture as in claim 8, wherein:

said at least one second lamp unit includes an array of individually focusable and switchable light sources.

13. The lighting fixture of claim 8, wherein:

at least one visual baffle is attached to said lighting fixture to protect viewers outside the activity area from glare created by the light sources of said fixture.

14. The lighting fixture of claim 13, wherein:

at least one of the said baffles comprises a reflector that is used to shape the light emission from the light sources of said lighting fixture.

15. A method of illuminating a localized activity area with very high energy efficiency and visual quality, comprising the steps of:

setting up one or more lighting fixtures, said fixtures having a plurality of lamp units functioning therein, said lamp units each containing one or more light sources that can be focused, switching two or more of said lamp units into an on position, focusing said one or more light sources on said localized activity area, and, thereafter, reconfiguring said lamp units on said fixture in an extended pattern that gives said fixture an aperture, or effective diameter, that is a significant fraction of the distance from said fixture to the illuminated activity area, whereby illumination of the area comes from a plurality of directions, aiming light beams from said light sources so as to combine on said activity area in an illumination pattern having desired characteristics.

16. A method as in claim 15, wherein:

a pair of said lighting fixtures is arranged on opposite sides of the activity area, at a level above a viewer's head, and to the side and somewhat to the rear of the viewer's usual position with respect to said activity area.

17. A method as in claim 15, wherein:

said plurality of lamp units in said lighting fixture at least includes a focusing reflector of large aperture that is combined with a lamp unit that is elongated along the optical axis of said reflector and directs light toward said reflector, whereby a majority of the light emitted by the said elongated lamp unit strikes the said reflector and is thereafter directed toward said activity area.

18. A method as in claim 17, wherein:

said lamp unit that is elongated along the optical axis of said reflector comprises a plurality of individually switchable LED light sources or other small light sources that can be aimed.

19. A method as in claim 17, wherein:

said lamp unit that is elongated along the optical axis of said reflector comprises a florescent tube or other individual light source having a light distribution pattern that emits most of the light toward the surface of said reflector.

20. A method as in claim 15, wherein:

at least one of said lamp units comprises an individually switchable cluster of LED's or other focusable light sources;

said cluster being mounted on said lighting fixture in a manner that allows said cluster to be aimed independently over a range of directions.

21. A method as in claim 15, wherein:

said plurality of lamp units in said lighting fixture includes an array of individually focusable and switchable light sources.

22. A method as in claim 15, wherein:

at least one visual baffle is attached to said lighting fixtures to protect viewers outside the activity area from glare created by the light sources of said fixtures.

23. A method as in claim 22, wherein:

at least one of the said baffles comprises a reflector that is used to shape the light emission from the light sources of said fixtures.

24. A method of illuminating a localized activity area with high energy efficiency and visual quality, comprising the steps of:

setting up two or more lighting fixtures, at least one of each said fixtures being located to each side of said activity area, and arranged so that all of said fixtures are mounted at a level above a viewer's head, and to the side and somewhat to the rear of the viewer's usual position with respect to said activity area;

switching on two or more lamp units in each of said fixtures, focusing one or more of said lamp units, reconfiguring said fixture so to array said lamp units in an extended pattern that gives said fixture an effective diameter that is a significant fraction of the distance from said fixture to the illuminated scene, whereby illumination of the scene comes from a plurality of directions; and, aiming light beams from said light sources in said fixtures so as to combine the lights on said activity area in an illumination pattern having desired characteristics.

25. A method as in claim 24, wherein:

said plurality of lamp units in said lighting fixture at least includes a focusing reflector of large aperture that is combined with a lamp unit that is elongated along the optical axis of said reflector and directs light toward said reflector, whereby a majority of the light emitted by said elongated lamp unit strikes said reflector and is thereafter directed toward said activity area.

26. A method as in claim 25, wherein:

said lamp unit that is elongated along the optical axis of said reflector comprises a plurality of individually switchable LED light sources or other small light sources that can be aimed.

27. A method as in claim 25, wherein:

said lamp unit that is elongated along the optical axis of said reflector comprises a florescent tube or other individual light source having a light distribution pattern that emits most of the light toward the surface of said reflector.

28. A method as in claim 24, wherein:

at least one of said lamp units comprises an individually switchable cluster of LED's or other focusable light sources;

said cluster being mounted on said lighting fixture in a manner that allows said cluster to be aimed independently over a range of directions.

29. A method as in claim 24, wherein:

said plurality of lamp units housed in said lighting fixture includes an array of individually focusable and switchable light sources.

30. A method as in claim 24, wherein:

at least one visual baffle is attached to said lighting fixtures to protect viewers outside the activity area from glare created by the light sources of said fixtures.

31. A method as in claim 30, wherein:

at least one of the said baffles comprises a reflector that is used to shape the light emission from the light sources of said fixtures.

* * * * *